US008082709B2

(12) United States Patent
Roberts

(10) Patent No.: US 8,082,709 B2
(45) Date of Patent: Dec. 27, 2011

(54) MODULAR CONSTRUCTION SYSTEM AND METHOD OF CONSTRUCTION

(76) Inventor: Matthew William Lewis Roberts, Chilton (GB)

( * ) Notice: Subject to any disclaimer, the term of this patent is extended or adjusted under 35 U.S.C. 154(b) by 0 days.

(21) Appl. No.: 12/450,412
(22) PCT Filed: Mar. 27, 2008
(86) PCT No.: PCT/GB2008/001104
§ 371 (c)(1), (2), (4) Date: Oct. 8, 2009
(87) PCT Pub. No.: WO2008/117074
PCT Pub. Date: Oct. 2, 2008

(65) Prior Publication Data

US 2010/0050558 A1 Mar. 4, 2010

(30) Foreign Application Priority Data

Mar. 27, 2007 (GB) ..... 0705867.0
May 27, 2007 (GB) ..... 0710019.1

(51) Int. Cl.
*E04B 1/00* (2006.01)
*E04B 1/02* (2006.01)
*A63H 33/06* (2006.01)

(52) U.S. Cl. ..... 52/284; 52/285.1; 52/584.1; 52/79.9; 52/79.13; 52/81.1; 52/DIG. 10; 52/271; 446/102; 446/119; 446/108; 446/122; 446/123

(58) Field of Classification Search ..... 52/79.1, 52/79.12, 234, 270, 284, 285.1, 271, 285.4, 52/584.1, 584.2, 585.1, 745.13, DIG. 10, 52/79.4, 79.9, 79.3, 123.1, 108, 223.7, 285.2, 52/286; 446/108, 112–115, 102, 104, 119, 446/120, 121–123, 124–125, 127–128
See application file for complete search history.

(56) References Cited

U.S. PATENT DOCUMENTS

| | | | | |
|---|---|---|---|---|
| 2,842,786 | A * | 7/1958 | Digby-Smith et al. | 14/6 |
| 2,941,371 | A * | 6/1960 | Benedict et al. | 405/285 |
| 3,287,051 | A * | 11/1966 | Anderson | 292/251.5 |
| 3,650,166 | A * | 3/1972 | Schmid | 82/149 |
| 4,694,629 | A * | 9/1987 | Azimi | 52/611 |
| 5,797,234 | A * | 8/1998 | Theodorou | 52/578 |
| 6,014,842 | A * | 1/2000 | Matsubara | 52/79.12 |
| 6,609,336 | B2 * | 8/2003 | Matsubara | 52/79.12 |
| 6,935,075 | B2 * | 8/2005 | Sherman | 52/79.1 |

FOREIGN PATENT DOCUMENTS

GB 2335211 A * 9/1999

* cited by examiner

*Primary Examiner* — Jeanette E. Chapman
(74) *Attorney, Agent, or Firm* — William H. Bollman

(57) ABSTRACT

The invention relates to a modular construction system. In particular, but not exclusively, the invention relates to a construction system, including modules, which are capable of being used in a wide range of applications including buildings and various other structures. Prior systems included structured modules connected by means of flexible joints which were composed of cables. These allowed relative movement between walls of various units. Such systems were complex and expensive to manufacture An improved modular construction system overcame this problem by providing a plurality of structural elements of V-shaped or chevron-shaped cross section. These are adapted to be assembled in a cellular configuration by their similar form, size and by virtue of the elements having apertures. Any aperture may receive a connector, which permits an amount of relative movement between said elements in two-rotational degrees of freedom.

7 Claims, 7 Drawing Sheets

MODULAR CONSTRUCTION SYSTEM AND METHOD OF CONSTRUCTION

BACKGROUND

This invention relates to a modular construction system. In particular, but not exclusively, the invention relates to a construction system, including modules, which are capable of being used in a wide range of applications including buildings and various other structures.

PRIOR ART

U.S. Pat. No. 5,797,234 (Theodorou) discloses structured modules connected by means of a joint that allows relative movement between walls in three degrees of freedom, via a flexible member, which connects various units one to another.

Examples of building systems which employ different shaped forms are disclosed in: U.S. Pat. No. 5,249,966 (Higli), which describes building blocks for educational purposes; and U.S. Pat. No. 4,723,382 (Lalvani), which describes building structures based on differing polygonal members.

US Patent Application US 2002/00584546 (Miller) discloses a system of interconnecting construction elements, for use as part of a toy. The system disclosed would not be suitable for use in a construction system for buildings.

Figure 1A:
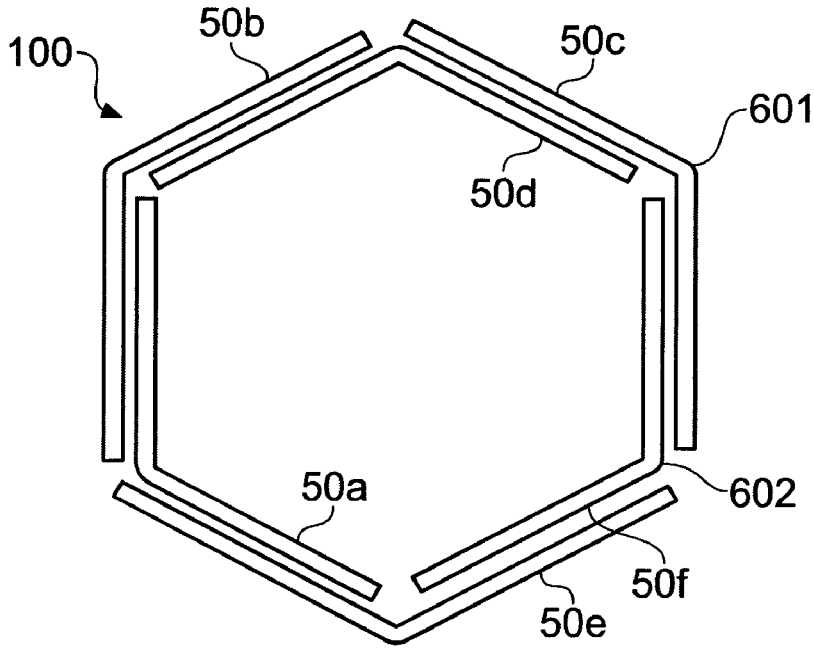
Figure 1B:
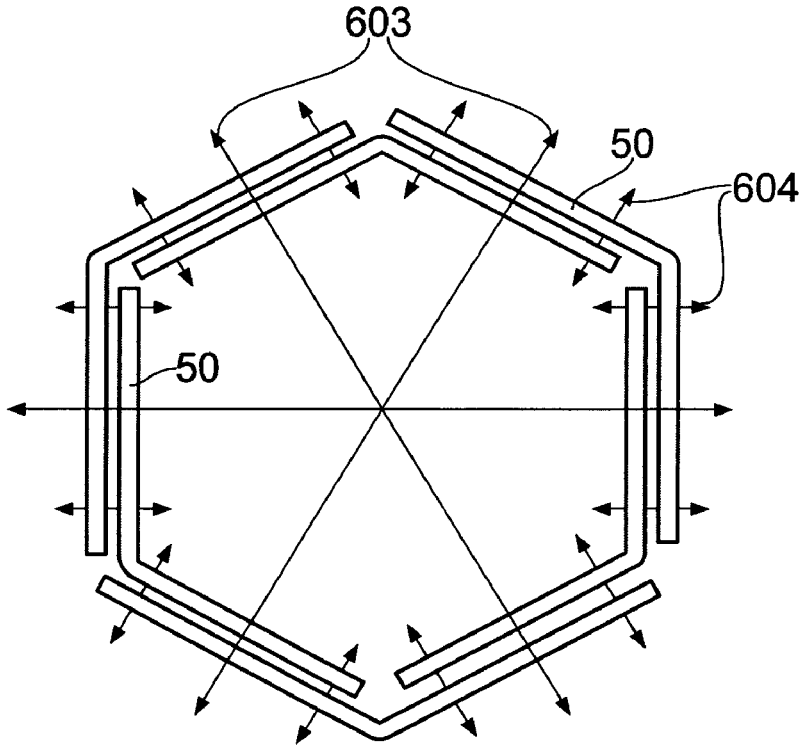

UK Patent Application GB-A-2 335 211 (Roberts) describes a hexagonal construction system. FIGS. 1a and 1b show plan and front elevation views of an element 49. The element is obtained by bending portions of a blank 46 vertically to form walls 50, as shown in perspective view in FIG. 2. A plurality of such elements can be assembled together to form a honeycomb structure.

It is an object of the invention to provide improved connecting means between constructional elements of the aforementioned, as well as similar type, which allow greater control and adjustment of a subtending angle defined between adjacent constructional elements. Typically by varying the subtending angle defined between adjacent constructional elements, adjacent sidewalls flex thereby enabling a radius of curvature to be defined.

SUMMARY OF INVENTION

According to a first aspect of the invention there is provided a modular construction system comprising: a plurality of structural elements of V-shaped or chevron-shaped cross section, adapted to be assembled in a cellular configuration, said elements having apertures formed therein and being adapted to receive a connector, which allows an amount of relative movement between said elements in two-rotational degrees of freedom.

Ideally reinforcement ties, bars or bracing units are provided for use in securing diametrically opposite points of a structure formed from said elements.

Connectors may be arranged to urge elements into a curved surface in two or three dimensions, the connectors including predominantly a plurality of identical blocks, said blocks comprising a prism having tapered sides.

Ideally the construction or portion thereof includes blocks that are substantially identical. Alternatively the construction, or a portion thereof, includes blocks whose bases are in the form of a frustum, whose base may be any of the following: triangular, square, rectangular or hexagonal.

According to another aspect of the invention there is provided a method of connecting walls of two structural elements one to another comprising the steps of: securing the walls by way of a connector, which connector allows an amount of relative movement between said elements in two-rotational degrees of freedom.

The second aspect is ideally used to connect V-shaped or chevron-shaped cross sectional modules, however, it will be appreciated that the method of connecting walls of two structural elements one to another, may be used to connect any shaped item or module.

Preferably the connector comprises a bolt-type member, adapted to be inserted into holes in the walls of the elements, having a thread for receiving a nut, and a pair of adjacent washers, one having a substantially concave surface the other having a substantially convex surface. When the convex and concave surfaces of contiguous washers are compressed, they cooperate to allow movement of the joint in two rotational degrees of movement. Spacers may be co-located within the joint. In an alternative arrangement both of the washers may be hemispherical. In a yet further embodiment at least a first and second flat portions adapted to be formed into a prism.

It will be appreciated that, in use, the bolt-type member may be threaded with said washers into appropriate holes in walls of a construction or structure. Similarly a construction may include a wedge between said walls co-located with, and by way of, said bolt-type member.

Ideally holes or apertures are provided in members, so that when members are placed in contact with one another, the holes align in contiguous walls of a structure for penetration by the threaded bolt-type members. Optionally washers are placed between nuts, bolt heads and co-operating convex and concave surfaces and spacers. The bolts may be fitted with corresponding threaded nuts. These may be tightened to clamp the washers, spacers, and contiguous walls of adjacent modules together.

The modular construction is ideally adapted to accommodate movement by way of at least two washers, spacers or other means, which in use are placed adjacent one another, whereby the overall construction is convex in one plane and optionally concave in another plane, so as to define a vault, dome or saddle curve.

Optionally an oversized aperture may be provided in the plates so that movement of the bolt is permitted therewithin. Alternatively there may be an undersized bolt and this too permits an additional degree of freedom of movement. The bolt type member is preferably a hollow threaded tube. In an enhanced embodiment a wedge is also co-located with the fixing.

It will be appreciated that by providing holes or apertures in the walls of the elements the passage of fluid, liquid, paste, hardenable filler or any other liquid material is permitted. Any such fluid material may be used as reinforcement, as a thermal or acoustic insulation medium, as a heat transfer medium or for any other purpose.

Where a liquid or semi-solid medium is introduced into contact with a part or fully assembled structure, a vibration device may be arranged to vibrate or jiggle a structure so that energy is transmitted therethrough thereby promoting the passage of the liquid medium through the holes. An advantage is that a pre-stressed concrete structure can be readily fabricated using a lattice or framework of the construction elements and the vibration of the liquid can be used to promote even distribution of the concrete and reduce the risk of voids occurring within the structure.

In this embodiment the invention may be incorporated as a casting to form floors, levels, steps, walkways or similar such structures.

Ideally elements are formed from a single strip by way of bending or flexing along one or more lines of weakness. Alternatively the two flat portions may be hinged, so that modules may be stored or transported flat and assembled in situ. The base of the prism may be triangular, square, rectangular, hexagonal or any closed polygon.

For the purposes of this description the term prism is intended to encompass both an object whose sides or faces are tapered or diminish in size, as well as one whose sides remain uniform and parallel. Thus, in the former sense the term prism includes a 'frustum' (or truncated pyramid); and in the latter the term prism applies to a solid of uniform cross sectional body. It is understood that the base of the frustum can be any appropriate closed polygon.

Means may be provided to permit the two flat portions to be angled and interconnected so as to build a structure from a plurality of modules, for example so as to enable the construction of larger items such as walls, floors, roofs, struts, beams and other such items.

Advantageously bracing and structural units are one and the same unit and comprise a bent sheet material of a generally V-shaped cross-section, ideally the included angle of which is approximately 60°, thereby permitting, in use, the formation of equilateral triangular networks, meshes, structures, shapes or forms.

The invention will now be described by way of examples and with reference to the following Figures in which:

BRIEF REFERENCE TO THE FIGURES

Figure 2A:
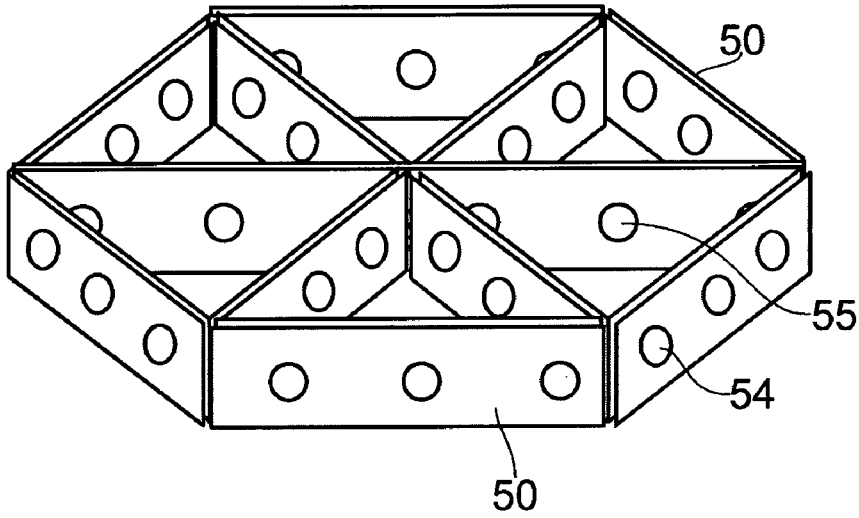
Figure 2B:
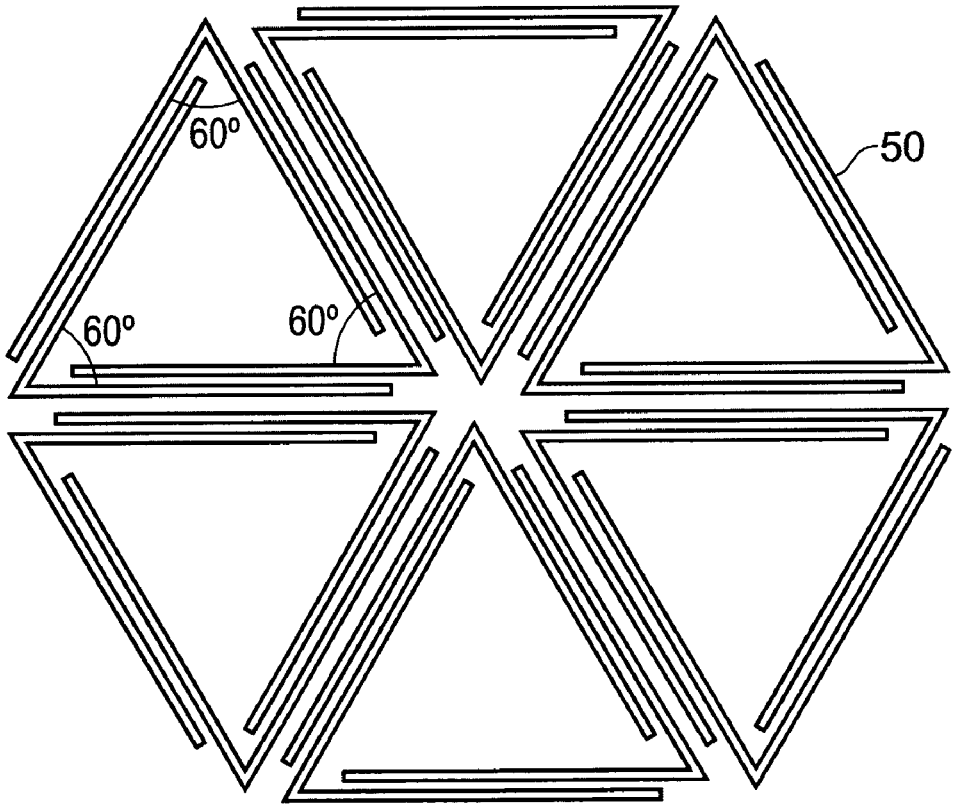
Figure 2C:
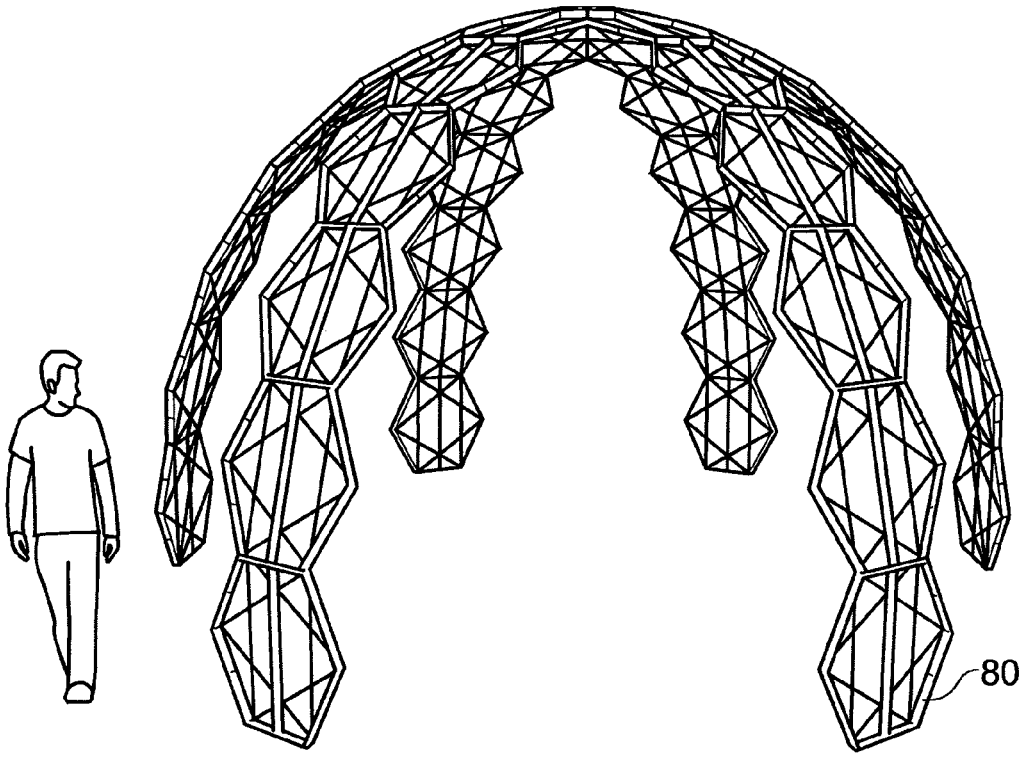
Figure 3A:
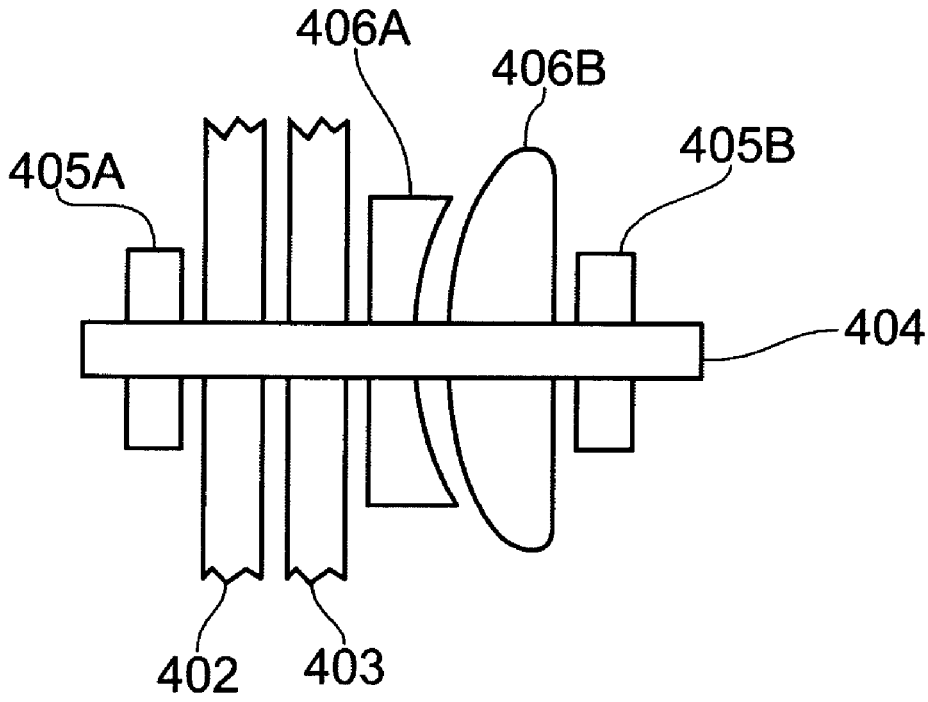
Figure 3B:
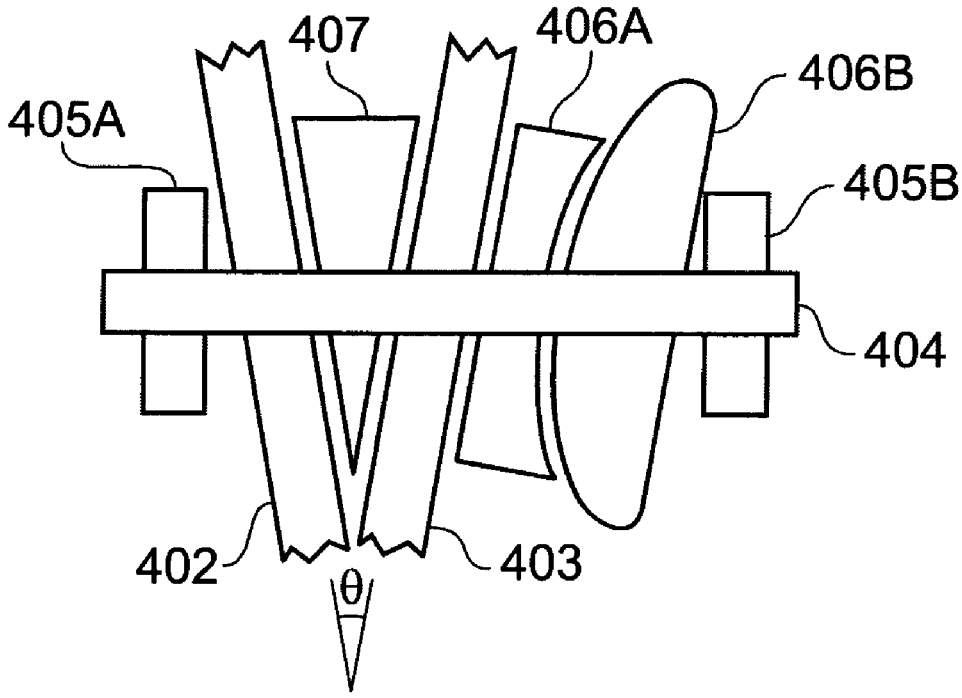
Figure 3C:
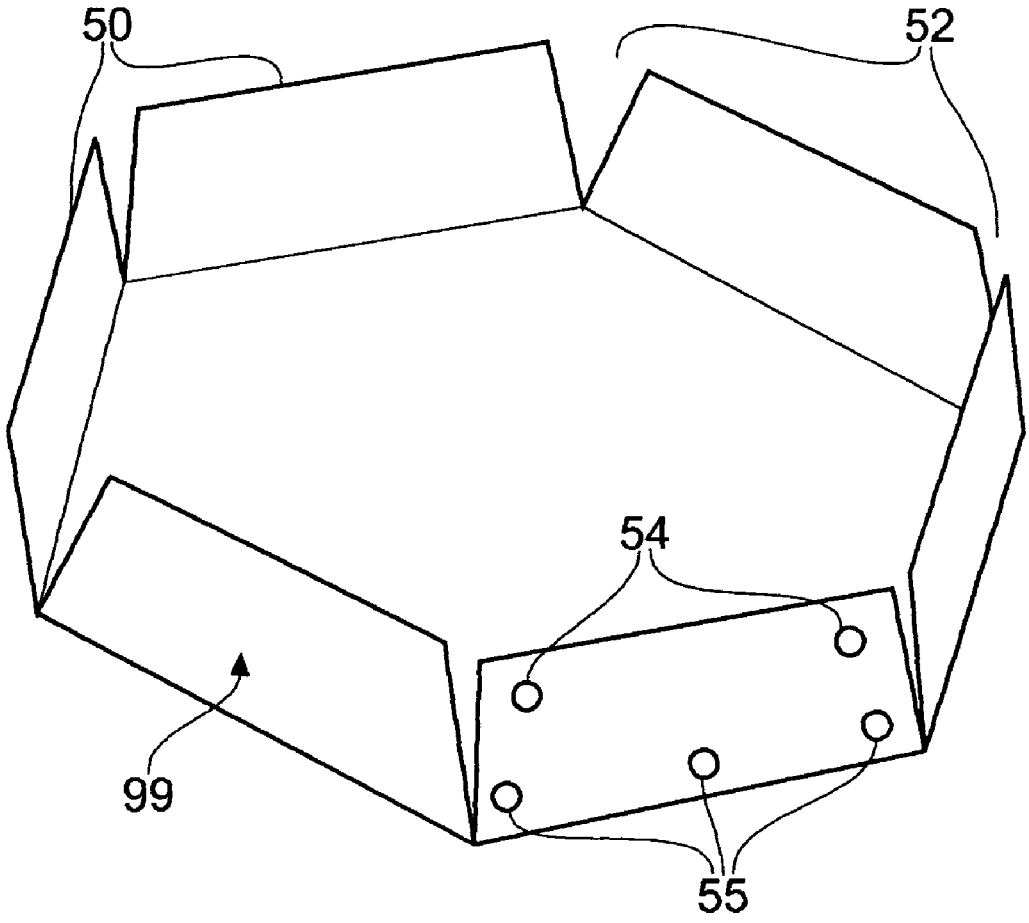
Figure 3D:
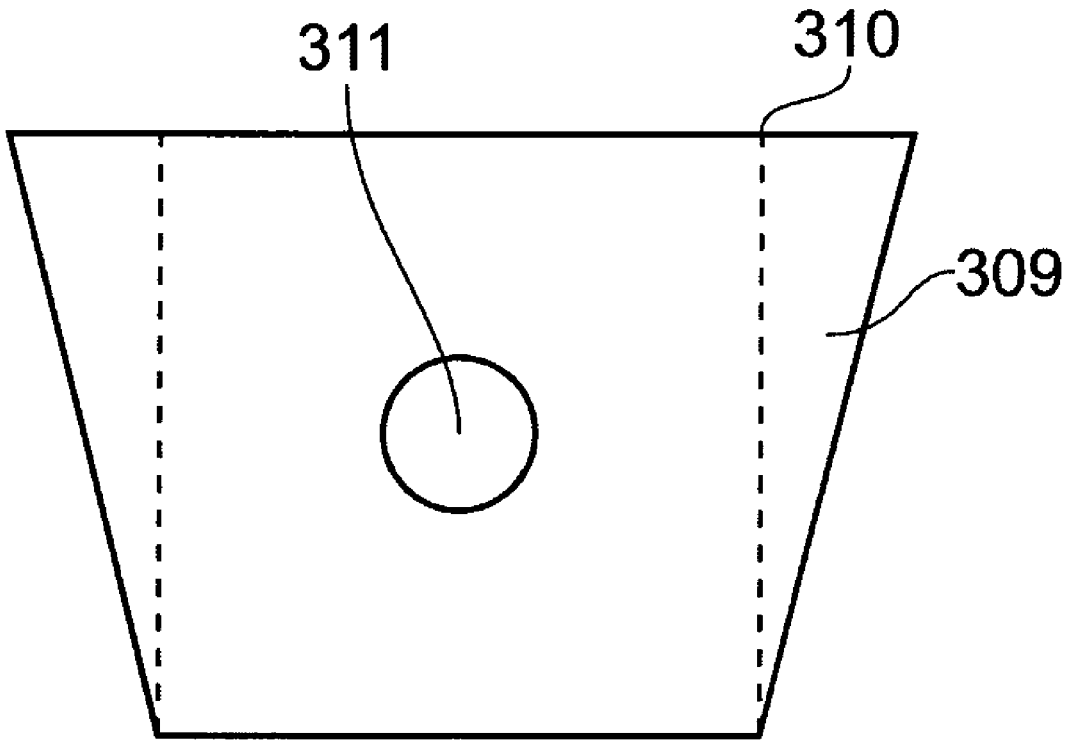
Figure 4:
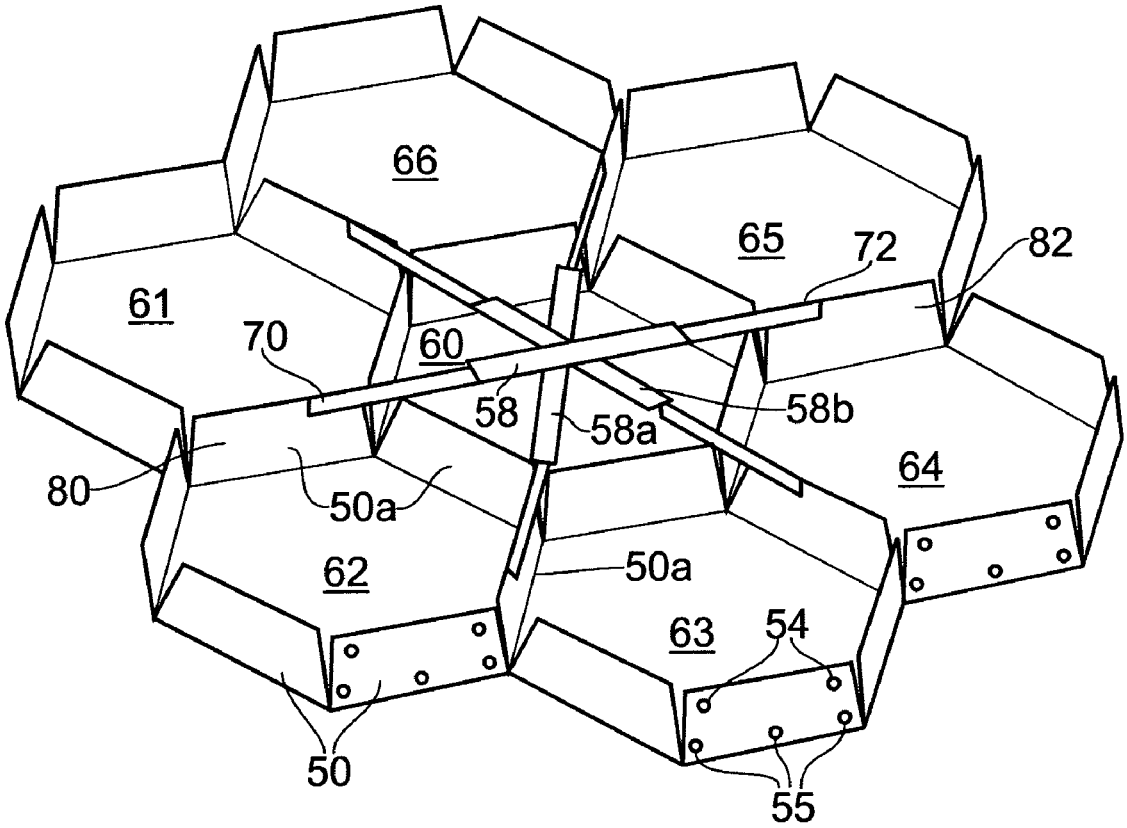

FIG. 1*a* shows a plan view of six construction modules adjacent one another;

FIG. 1*b* shows plan view of six construction modules connected one to another;

FIG. 2*a* shows an overall view of a construction module of hexagonal form with integral diametrical bracing;

FIG. 2*b* shows a diagrammatical plan view of construction module of hexagonal form with overlapped V-shaped elements, both with integral bracing;

FIG. 2*c* is an overall diagrammatic view of a domed structure formed from a plurality of modules of hexagonal form;

FIG. 3*a* shows a cross-sectional side elevation of a variable angle compressive side connecting joint according to one embodiment of the invention;

FIG. 3*b* shows a cross-sectional side elevation of a variable angle compressive side connecting joint including a co-located wedge shaped spacer;

FIG. 3*c* is an overall diagrammatic view of an open structure, suitable to be assembled in to a modular array;

FIG. 3*d* is a plan view of a blank which when folded is suitable for use against a surface, as a wedge or prism; and FIG. 4 is an overall, diagrammatical view of seven assembled modules, positioned adjacent one another in an array and capable of interconnection one to another, for example by way of rigid rods through aligned holes or apertures.

DETAILED DESCRIPTION OF PREFERRED EMBODIMENTS OF THE INVENTION

Referring to the Figures, FIG. 1*a* shows a diagrammatical plan view of construction module 100 of a generally hexagonal form having no peripheral bracing. Module 100 comprises six identical steel plates 50*a*, 50*b*, 50*c*, 50*d*, 50*e* and 50*f* bent into chevron form units or components in chevron form. Outer modules 50*b*, 50*c* and 50*e* act as peripheral brace member for 50*a*, 50*d* and 50*f*. Because effectively joint components are the same as bracing components, this reduces the number of types of components required.

FIG. 1*b* is an overall, diagrammatical view of six modules interconnected by way of three rigid or hollow rods 603. Holes or apertures are disposed throughout the assembled structure. An enhanced embodiment of the invention may also include cylindrical steel tubes as well as pipe and nut fixtures (not shown) as described above.

FIGS. 2*a* and 2*b* show further embodiments of the invention wherein a hexagonal modular structural element is formed from components 50 with holes or apertures 54 and 55 formed therein. The structure is made up from 6 equilateral triangular forms. As can be seen from FIG. 2*b* the triangular sub-modules and hexagonal module formed therefrom are defined either by interlocking V-shaped plates or equilateral triangular shaped forms. These plates or forms generally have an angle of 60° so as to define an equilateral triangle.

FIG. 2*c* is an overall diagrammatic view of a domed structure 80 formed from a plurality of modules of hexagonal form, for example of the type shown in FIG. 4, but interconnected with angled joints. Adjacent modules are connected, for example by use of variable angle compressive side connecting joint, of the type shown in FIG. 3*b*. This imparts an overall curvature to the assemblage. An advantage of the modular structure is that it is capable of flexing and adopting a shape that conforms to an applied force.

Plates 50 may be formed for, example by cutting or punching, a thin sheet of metal (not shown), such as sheet steel. The ideal shape of the element is either a: V-shaped form (produced by folding a strip so that two ends subtend an angle of 60°) or an equilateral triangle (produced by folding a strip twice to form a closed loop, so that three angles of 60° are subtended). Apertures or holes 54, 55 (shown in FIG. 4) may be pre-formed into the metal sheet (prior to elements being cut) or cut or punched after elements 50 have been cut or formed. Elements 50 are then bent along a fold or suitable line of weakness. At any stage of the process a line of weakness, such as a crease, fold or a scoring line may be formed on the metal sheet.

Referring to FIGS. 2*a* and 2*b*, in which structural walls 50 and bracings 50 are of similar form. This is termed 'integral' bracing. The advantage is that only one type of constructional element is needed. This saves time and money. An hexagonal module, of the type shown in FIG. 4 can be formed using as few as four such elements.

It is to be understood that bent sheet material for the components does not have to be bent during their manufacture. Components may be moulded or formed as such. Thus the term 'bent' should be construed to include any such element having sheet like portions, which are at an angle to each other and have a common edge. They may even be hinged, sold and transported in this form. It is advantageous to build structures from modules and UK Patent Application GB-A-2 335 211 describes example of hexagonal construction modules.

The invention described herein may be used as piling and when arranged in hexagonal, cellular form is suitable as part of sea or coastal defence barrier. Alternatively, when assembled as hereinafter described, modules may be used to form an internal strengthening framework for a walkway, building or other construction.

Referring now briefly to FIG. 3*a*, there is shown a module with two side walls 402 and 403 such as sheet metal (or walls 50) of connected and compressed together in contiguous alignment by means of an externally threaded pipe 404 and two locking means, which are nuts 405A, 405B. Also included are co-operating dished and hemispherical washers 406A and 406B respectively. Such curved washers allow fixture of the side elements at different angles without causing uneven pressure concentrations. The threaded pipe and nut fixtures can be set a variable torque pressures also; this allows greater control of the rigidity of the structure during construction.

FIG. 3*b* shows an enhanced embodiment of the invention; it is identical to the embodiment shown in FIG. 3*a* except that it includes a wedge 407 or tapered spacer 407 (at a first taper angle θ) between the sidewalls 402 and 403, again allowing fixtures to be arranged with respect one to another at a chosen angle. In particular the wedge 407 includes a hole, which allows it to be co-located with a connecting joint, thereby ensuring it is fixed in the correct location.

In FIG. 3*b,* when nut 405A is tightened (in a contra-torque sense with respect to nut 405B) and abuts flush with respect to slanted side of the joint, nuts 405A and 405B align so that their faces are contiguous with the sheets 402 and 406B respectively as a result contra-torque.

It will be understood that there are various alternative designs, which fall within the scope of the invention that would be known to the skilled person. A nut and bolt arrangement may replace two nub balls and hollow tube arrangement. Also it is to be appreciated that the bolt type member may have a middle section devoid of threading to allow spacing.

FIG. 3*c* is an overall diagrammatic view of an open structure 99, suitable for assembling in to a modular array and having walls 50 which have a slight tapering 52.

FIG. 3*d* is a plan view of a blank 309 which when folded along lines 310, forms a wedge that is suitable for use against a surface, as a wedge or prism. In use a bolt or connector passes through aperture 311.

FIG. 4 is an overall, diagrammatical view of seven assembled modules 60, 61, 62, 63, 64, 65 and 66 positioned adjacent one another and capable of being interconnected. In the example shown three rods 58, 58*a* and 58*b* interconnect the seven modules, for example through holes or apertures aligned throughout the assembled structure. Connectors 58, 58*a* and 58*b* may be of the type described with reference to FIGS. 3*a* and 3*b*. The term 'module' is intended to describe a complete hexagonal form and the term assemblage is intended to encompass more than two or more such modules when connected.

As mentioned above, with reference to FIG. 2*c,* when modules are connected using the connectors of FIGS. 3*a* and 3*b,* along adjacent plates (50*a,* 50*b,* 50*c,* 50*d,* 50*e* and 50*f* in FIG. 1), a curved form is imparted to the overall assemblage.

Although the invention has been described by way of preferred embodiments, it will be appreciated that variation may be made to the embodiments, without departing from the scope of the invention. For example, it will be appreciated that another application of the invention is for use as an architectural or any other modelling technique where a readily deployable system can be used to build a scale model quickly and cheaply.

Although reference has been made to the use of steel as a construction medium it will be appreciated that other materials or composites may be used in the sheets and/or connectors including: synthetic plastics, carbon fibres, alloys, glass reinforced plastics, aluminium, polymers or any combination of the aforesaid materials.

The invention claimed is:

1. A modular construction system comprising:

a plurality of structural elements of V-shaped or chevron-shaped cross section, adapted to be assembled in a cellular configuration, said elements having apertures formed therein and being adapted to receive a connector, which allows an amount of relative movement between said plurality of structural elements in two-rotational degrees of freedom; and a single threaded bolt-type member, threaded with a pair of adjacent washers, to clamp sliding surfaces;

wherein said movement is provided by said pair of adjacent washers, one washer having a substantially dish shaped concave surface and the other washer having a substantially hemispherical convex surface.

2. A modular construction system as claimed in claim 1, including:

a wedge located between said plurality of structural elements and co-located with and by said threaded bolt-type member.

3. A modular construction system as claimed in claim 2, further comprising:

a hollow threaded tube.

4. A modular construction system according to claim 1, wherein:

said plurality of structural elements are substantially identical.

5. A modular construction system according to claim 1, wherein:

said V-shaped cross-section subtends an angle of approximately 60° .

6. A modular construction system according to claim 1, wherein:

said movement is permitted by way of a base of a frustum being at least one of triangle, square, rectangle and hexagon.

7. A modular construction system according to claim 1, further comprising:

modules defining a three-dimensionally curved surface comprising predominantly of a first group of identical blocks, said identical blocks comprising a prism having tapered sides.

* * * * *